US006960143B2

(12) United States Patent
Sato

(10) Patent No.: US 6,960,143 B2
(45) Date of Patent: Nov. 1, 2005

(54) GOLF TEE

(75) Inventor: Akiyoshi Sato, Nagano (JP)

(73) Assignee: Sato Factory Co., Ltd., Nagano-ken (JP)

( * ) Notice: Subject to any disclaimer, the term of this patent is extended or adjusted under 35 U.S.C. 154(b) by 0 days.

(21) Appl. No.: 10/422,962

(22) Filed: Apr. 25, 2003

(65) Prior Publication Data

US 2003/0228939 A1 Dec. 11, 2003

(30) Foreign Application Priority Data

Apr. 25, 2002 (JP) ..... 2002-124726

(51) Int. Cl.[7] ..... A63B 57/00
(52) U.S. Cl. ..... 473/387
(58) Field of Search ..... 473/387–403

(56) References Cited

U.S. PATENT DOCUMENTS

| | | | | | |
|---|---|---|---|---|---|
| 1,671,813 | A | * | 5/1928 | Clarke | 473/403 |
| D161,602 | S | * | 1/1951 | Ward | 473/402 |
| 3,907,289 | A | * | 9/1975 | Bondu, Sr. | 473/403 |
| 4,909,508 | A | * | 3/1990 | Noland et al. | 473/399 |
| 5,040,792 | A | * | 8/1991 | Takigawa | 473/399 |
| 5,046,730 | A | * | 9/1991 | Golden et al. | 473/399 |
| 5,571,054 | A | * | 11/1996 | Chantal | 473/387 |
| 5,738,598 | A | * | 4/1998 | Wu | 473/392 |
| 6,290,616 | B1 | * | 9/2001 | Evans et al. | 473/399 |

FOREIGN PATENT DOCUMENTS

| | | |
|---|---|---|
| JP | 62-183870 U | 11/1987 |
| JP | 3-254768 A | 11/1991 |

* cited by examiner

*Primary Examiner*—Steven Wong
(74) *Attorney, Agent, or Firm*—Birch, Stewart, Kolasch & Birch, LLP

(57) ABSTRACT

A molded golf tee prepared by molding a molding material composed of sand and at least a predetermined quantity of binder in a mold, the molded golf tee having a concave hollow portion with a predetermined depth from an upper end, is provided. According to this, when the golf tee is hit with a club for hitting a ball, the golf tee including a concave hollow portion breaks into pieces, so that resistance (impact pressure) is reduced when the golf tee is hit with the club.

13 Claims, 4 Drawing Sheets

GOLF TEE

BACKGROUND OF THE INVENTION

1. Field of the Invention

The present invention relates to a golf tee molded from sand with a mold.

2. Description of the Related Art

Conventionally, typical golf tees used in golf are molded from inexpensive, lightweight plastic materials. However, when plastic golf tees are left on golf courses, the shapes thereof remain unchanged. Therefore, the golf tees must be recovered. When the golf tees are not recovered, they may adversely affect the natural environment. For example, birds may swallow them. Golf tees molded from soil as a molding material are also disclosed in, for example, Japanese Unexamined Utility Model Registration Application Publication No. 62(1987)-183870 and Japanese Unexamined Patent Application Publication No. 3(1991)-254768. The former discloses a golf tee formed by solid molding using a granular, powdered material, such as soil, in order that a receiving portion thereof has strength adequate for supporting a ball during use, and weathering proceeds speedily by rainwater, sunlight, etc., after using. The latter discloses a golf tee formed into the shape of a tee by mixing and integrating 10% to 60% by weight of charcoal, 5% to 30% by weight of fertilizer, the remainder composed of soil, and an appropriate quantity of shaping accelerator for shaping them. Since the golf tees using soil use materials existing inherently in the natural environment, that is, materials constituting the ground, recovery is not required, and the problem of birds swallowing golf tees does not occur.

However, since a golf tee using soil or sand, especially sand which is an aggregate of granular materials, is unlikely to have a reduced thickness, the golf tee must be molded into a massive shape as a whole, and therefore, the weight thereof becomes significantly larger than that of a plastic material. As a result, in particular, resistance becomes large when the golf tee is hit with a club when hitting a ball, so that the carry of the ball is decreased, and in addition, there are disadvantages from the viewpoint of portability and cost reduction.

SUMMARY OF THE INVENTION

It is an object of the present invention to provide a golf tee capable of increasing the carry of a ball by reducing resistance when the golf tee is hit with a club.

It is another object of the present invention to provide a golf tee capable of further improving portability and cost reduction by decreasing the amount of molding material required.

In order to achieve the aforementioned objects, according to an aspect of the present invention, a molded golf tee prepared by molding a molding material composed of sand and at least a predetermined quantity of binder in a mold, the molded golf tee having a concave hollow portion with a predetermined depth from an upper end, is provided. According to this, when the golf tee is hit with a club for hitting a ball, the golf tee including the concave hollow portion breaks into pieces, so that resistance is reduced when the golf tee is hit with the club. Preferably, the depth of the concave hollow portion is specified to be one-third or more of the total longitudinal length.

DESCRIPTION OF THE PREFERRED EMBODIMENTS

The preferred embodiments according to the present invention will be described in detail with reference to the drawings. The attached drawings do not limit the present invention, but are provided to make the present invention easily understandable. In order to avoid a complicated description of the present invention, detailed explanations of known portions will not be provided.

The configuration of a golf tee T according to the present embodiment will be described with reference to FIG. 1 and FIG. 2.

The golf tee T is composed of a molded material integrally molded from a molding material M in which at least a predetermined quantity of binder C is added to sand S. As the binder C, for example, a phenolic resin or other thermosetting curing agent capable of consolidating the sand S may be used. As this type of binder C, other curing agents may be used, and in addition, additives for further enhancing the consolidation effect may be used. Biodegradable resins (biodegradable plastics) may also be used. The biodegradable resins are naturally decomposed even when left outdoors, and are converted into low-molecular-weight compounds. Therefore, when the environment is taken into consideration, the biodegradable resins are more preferable materials. On the other hand, core sand (silica sand) used in the manufacture of a hollow portion during casting may be used as the sand S.

This golf tee T is composed of a lower-half portion Td formed into the shape of a cylinder and an upper-half portion Tu gradually increasing in diameter upwardly (in the shape of an inverted circular cone) from an upper end of the lower-half portion Td. The lower end of the lower-half portion Td is formed into a pointed shape (the shape of an inverted circular cone). Furthermore, a concave hollow portion Tw having a predetermined depth from an upper end (upper end surface) Tp of the upper-half portion Tu is arranged inside the golf tee T. As shown in FIG. 1, the depth Lw of this concave hollow portion Tw is preferably specified to be one-third or more of the total longitudinal length L. In the embodiment, the concave hollow portion Tw occupies all of the upper-half portion Tu and a part of the lower-half portion Td. According to this, the upper-half portion Tu is formed into the shape of a cup by a wall portion Wt of about 1 mm thickness. Desirably, the thickness of the wall portion Wt is specified to be in the order of 0.7 to 2 mm in consideration of ensuring satisfactory strength and ease of breakage during use (hitting the ball).

Figure 1:
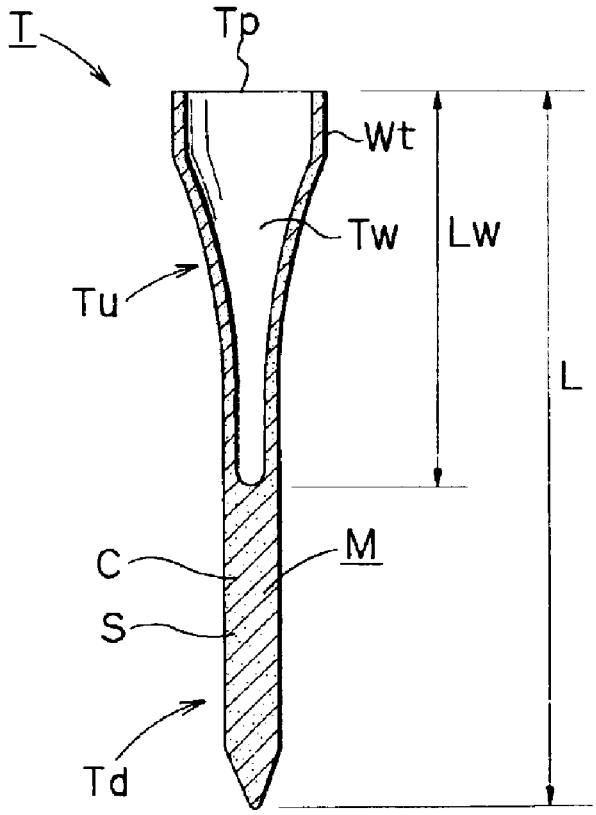
FIG. 1 is a vertical sectional view of a golf tee according to a preferred embodiment of the present invention.

As can be seen in FIG. 1. the golf tee T having the upper half-portion Tu and the lower-half portion Td includes a cylindrical-shaped upper portion surrounded by a cylindrical-shaped wall portion Wt at an upper most end of the upper half-portion Tu; the cylindrical-shaped upper portion extending a predetermined depth from an upper end of the tee T; a concave hollow portion Tw formed beneath the cylindrical-shaped upper portion. Further, the concave hollow portion Tw has an inner surface flaring outwardly in a single continuous curve, extending from a hemispherical-shaped bottom to the cylindrical-shaped upper portion, and joining the cylindrical-shaped upper portion at an obtuse angle, the hemispherical-shaped bottom being located at a bottom of the upper half-portion Tu.

A method for manufacturing the golf tee T according to the present embodiment will be described with reference to FIG. 3.

Figure 3:
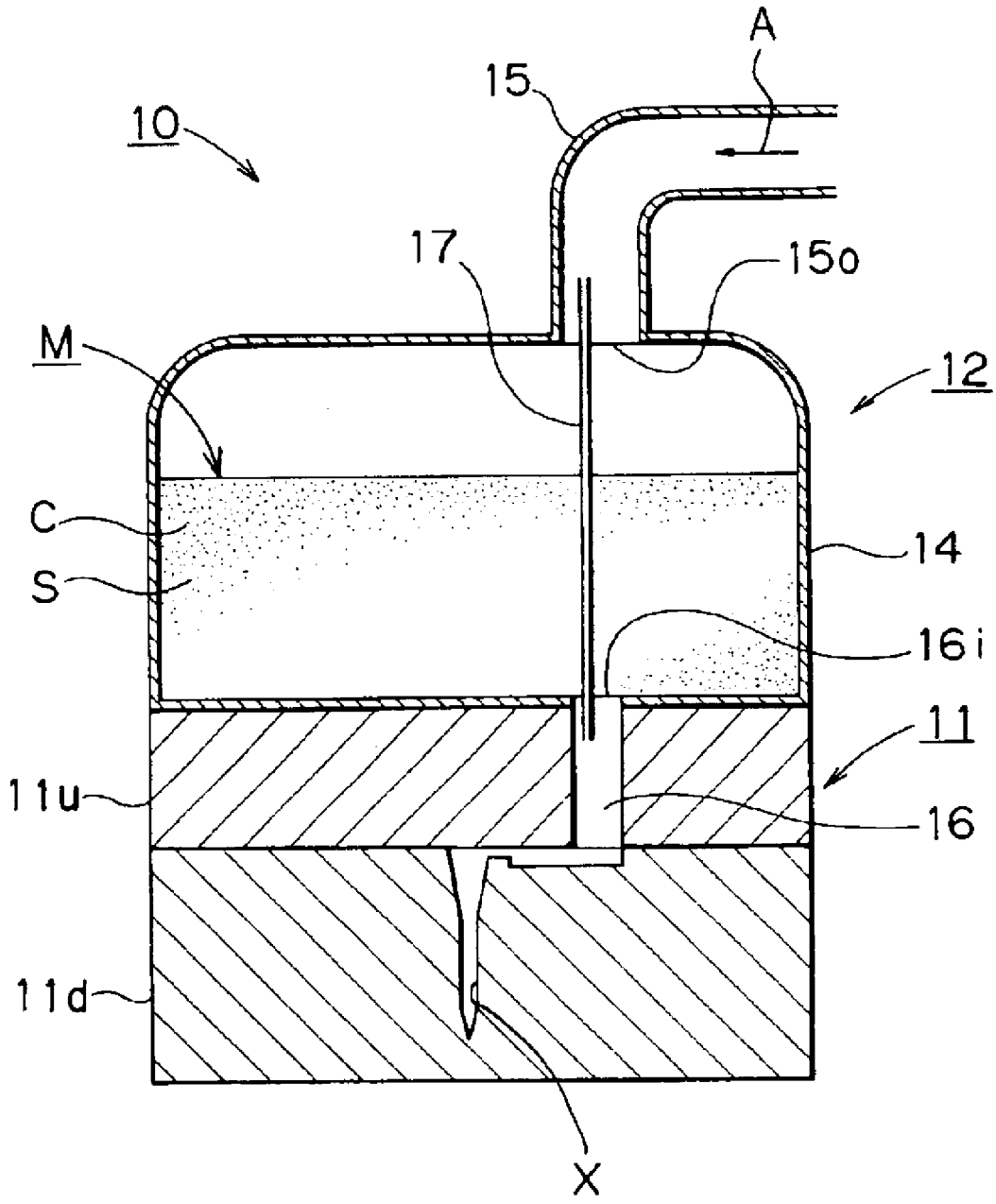
FIG. 3 is a vertical sectional view of a golf tee molding machine used for manufacturing the golf tee shown in FIG. 1.

FIG. 3 shows a golf tee molding machine 10. This golf tee molding machine 10 is provided with a mold portion 11 and a material blowing device 12. The mold portion 11 is composed of an upper mold 11*u* and a lower mold 11*d*, and on the opposing face (parting face), a cavity (mold) X in the shape of the golf tee is arranged. In this case, as shown in FIG. 3, regarding the cavity (mold) X, a shape of only an outer hull of the golf tee is formed and no core portion for forming the aforementioned concave hollow portion Tw exists.

On the other hand, the material blowing device 12 includes a tank 14 for storing the molding material M, and compressed air A can be supplied through a duct 15 to this tank 14 from above. The molding material M stored in the tank 14 is composed of the sand S containing a predetermined quantity of the binder C as described above.

When a phenolic resin, for example, which does no harm to the environment is used as the binder C, it is essential that in the order of 1.5% to 2.0% by weight of phenolic resin is mixed relative to the sand S. The usage of the phenolic resin may be reduced to the order of 0.7% to 1.3% by weight, and the binding force may be increased by an adhesive, secondary treatment, etc. Regarding the secondary treatment, the golf tee T after molding may be coated with a plant-derived secondary curing agent. For example, when the golf tee T after molding is immersed in and thereby coated with a mucilage in which an agar powder and a glutinous rice powder are dissolved into a solution, followed by subsequent drying, the binding force can be increased by a large degree. When a food colorant is added to this mucilage, coloring can be performed simultaneously. Regarding the adhesive, about 0.5% to 3.0% by weight of rice bran may be added relative to the phenolic resin. According to this, when the golf tee T is left sanding on the ground after using, rainwater, etc., penetrates into the rice bran, and thereby, the breakdown property of the golf tee T left on the ground can be enhanced. By mixing the binder C and the sand S, the molding material M in which the binder C is adhered to the surface of the sand S can be produced. In this case, the molding material M apparently produces a feeling similar to that of dry sand.

On the other hand, the bottom portion of the tank 14 and the cavity X communicate with each other through a blow hole 16. An outlet 15*o* of the duct 15 and an inlet 16*i* of the blow hole 16 communicate with each other through a bypass tube 17 for passing through part of the compressed air A supplied from the duct 15. The bypass tube 17 is specified to have a diameter which does not interfere with blowing of the molding material M into the blow hole 16.

Consequently, the compressed air A is supplied into the tank 14 through the duct 15 during molding, and the molding material M is pressured at an applied pressure in the order of 1 atmosphere (0.01 Pa) for 0.5 to 0.6 sec. According to this, the cavity X is filled with the molding material M. At this time, molding is essentially performed by a core molding technology. In addition, a part of the compressed air A in the duct 15 directly reaches the blow hole 16 through the bypass tube 17, and thereby achieves the blowing of the molding material M. According to this, even with a relatively small cavity X, the molding material M can effectively be filled into all parts of the cavity X.

Immediately after a pressuring time lapse of 0.5 to 0.6 sec, as described above, the application of pressure is released, and a treatment for removing any non-adhering molding material M from the cavity X is performed. In this case, when the cavity X is filled with the molding material M, since the inside of the cavity X has been heated to a high temperature, adhesion of the molding material M in the cavity X proceeds from the surface side with time. Consequently, when the treatment for removing the non-adhering molding material M from the cavity X is performed after a lapse of a predetermined time after the cavity X is filled with the molding material M, the non-adhering molding material M present inside the molded material M (golf tee) is discharged to the outside, and thereby, the concave hollow portion Tw can be produced. Regarding the treatment for removing the non-adhering molding material M from the cavity X, in the case shown in FIG. 3, the treatment can be performed by applying a negative pressure, and in the case where a molding machine is the vertically reverse equivalent of the golf tee molding machine 10 shown in FIG. 3, the non-adhering molding material M can be removed based on free fall by releasing the supply of the compressed air A, and performing an operation of so-called air release. As a result, the golf tee T shown in FIG. 1 can be produced.

A method for using the golf tee according to the present embodiment will be described with reference to FIG. 4.

Figure 4:
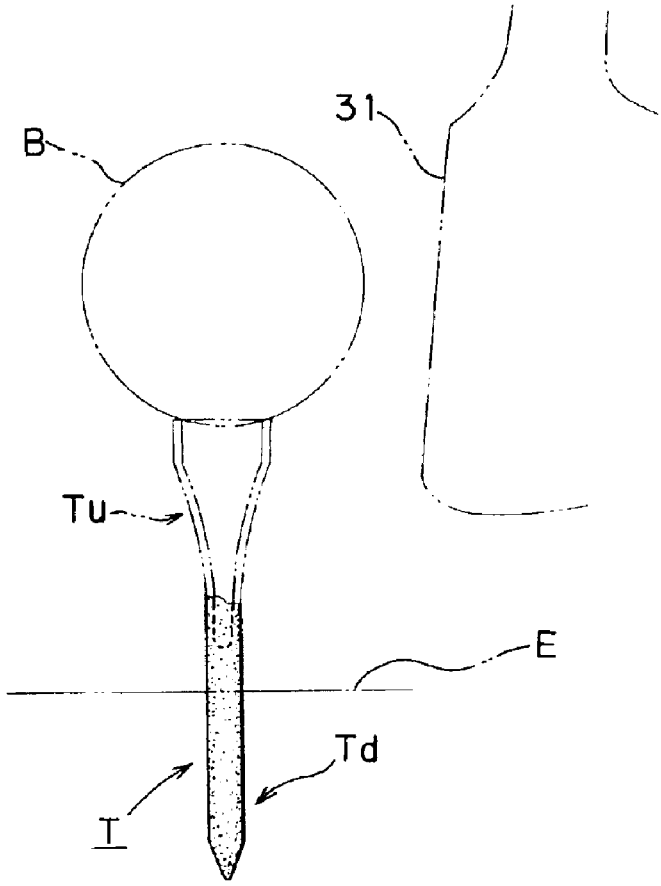
FIG. 4 is a diagram illustrating use (action) of the golf tee shown in FIG. 1.

The method for using the golf tee T is basically the same as that of a regular golf tee, and therefore, the golf tee T is used while the lower-half portion Td is inserted into the ground E as shown in FIG. 4. Subsequently, a ball B is placed on the upper end of the golf tee T, that is, the upper end Tp of the upper-half portion Tu, and the ball B is hit with a wood 31 (club).

When the golf tee T is hit with the wood 31, the upper-half portion Tu in particular breaks into pieces. That is, since the concave hollow portion Tw and the thin wall portion Wt are provided, the upper-half portion Tu breaks with ease after being hit with the wood 31. FIG. 4 shows the condition in which the upper-half portion Tu has broken. As a result, resistance (impact pressure) at the time of hitting a ball B with the wood 31 is reduced by about 15% on an average basis compared with that of golf tees formed from rigid materials, for example, plastic, and the following results were attained.

(a) When the ball B is hit at the position offset from the center of the wood 31 toward the tip side (the side farther from a player) by 2 to 3 cm, in the case of a conventional golf tee formed from a rigid material, for example, plastic, since resistance when the golf tee is hit with the wood 31 is relatively increased, the wood 31 is slightly rotated about the golf tee, and thereby, a tendency to curve the ball rightward is brought about. However, regarding the golf tee T according to the present embodiment, the influence of the position at which the ball B is hit with the wood 31 is reduced, and therefore, precise directional control can be achieved. Consequently, the golf tee T is especially suitable for beginners.

(b) Since the resistance (impact pressure) when the ball B is hit with the wood 31 is decreased, the carry of the ball B can be increased.

In particular, the improvement effect of the aforementioned (a) is significant, and this improvement effect is increased with an increase in the hardness of the ground. The degree of breakage of the upper-half portion Tu can be controlled by selection of the diameter of the concave hollow portion Tw (thickness of the wall portion Wt), and also be controlled by the pressure of the compressed air A during molding, the sort of binder C, the ratio of binder C relative to the sand S, mixing of other additives, etc. Since the concave hollow portion Tw is provided in the golf tee T, the amount of molding material M required is reduced correspondingly, and portability and cost reduction can be improved.

Next, a golf tee Ts according to a modified embodiment of the present invention will be described with reference to FIG. 5 to FIG. 7.

Figure 2:
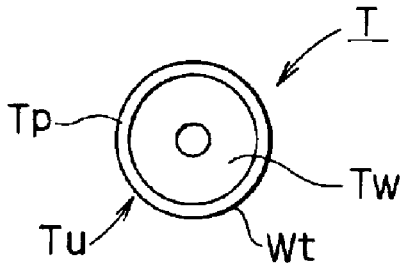
FIG. 2 is a plan view of the golf tee shown in FIG. 1.

The golf tee T shown in FIG. 1 and FIG. 2 (FIG. 4) is effective for increasing the carry of the ball B when hit with the wood 31. On the other hand, the golf tee Ts shown in FIG. 5 to FIG. 7 can achieve excellent control of the ball B when hit with an iron 32 (FIG. 7).

Figure 5:
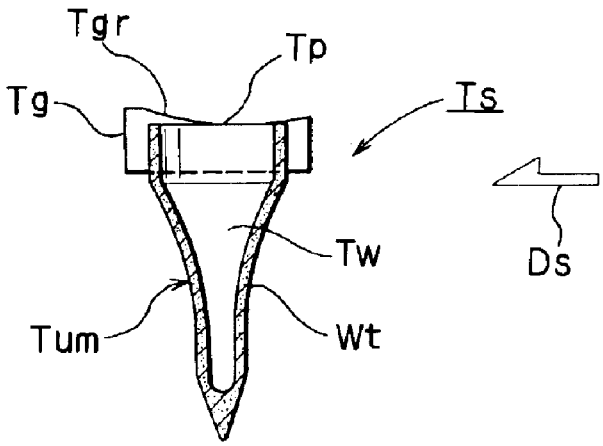
FIG. 5 is a vertical sectional side view of a golf tee according to another preferred embodiment of the present invention.
Figure 6:
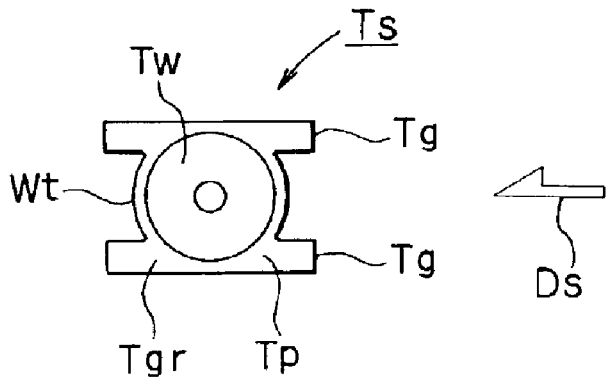
FIG. 6 is a plan view of the golf tee shown in FIG. 5.

As shown in FIG. 5 and FIG. 6, this golf tee Ts includes a main body Tum, the total shape thereof being specified to have nearly the same shape and size as those of the upper-half portion Tu of the aforementioned golf tee T. Consequently, the main body Tum corresponds to the upper-half portion Tu of the aforementioned golf tee T except that the lower end is formed into a pointed shape (the shape of an inverted circular cone). Therefore, the concave hollow portion Tw is arranged throughout the golf tee Ts.

Furthermore, guide portions Tg and Tg for supporting the ball B and guiding the ball B in a hitting direction Ds are arranged integrally at the upper end Tp of the main body Tum. A pair of guide portions Tg and Tg are arranged on the right and left sides of the hitting direction Ds. The guide portions Tg and Tg are arranged in the shape of parallel rails for supporting the ball B, and the top surfaces of the guide portions Tg and Tg projecting from the upper end Tp constitute ball placement surfaces Tgr and Tgr. As shown in FIG. 5, the ball placement surfaces Tgr and Tgr are formed into curved surfaces having intermediate portions slightly dented downward, and in addition, the front end in the hitting direction is located at a position higher than that of the rear end. The other configurations, manufacturing method, etc., are the same as those of the aforementioned golf tee T. Therefore, in FIG. 5 to FIG. 7, the same portions as those in FIG. 1 to FIG. 4 are indicated by the same reference numerals in order to clarify the configuration, and detailed explanations thereof will not be provided.

Figure 7:
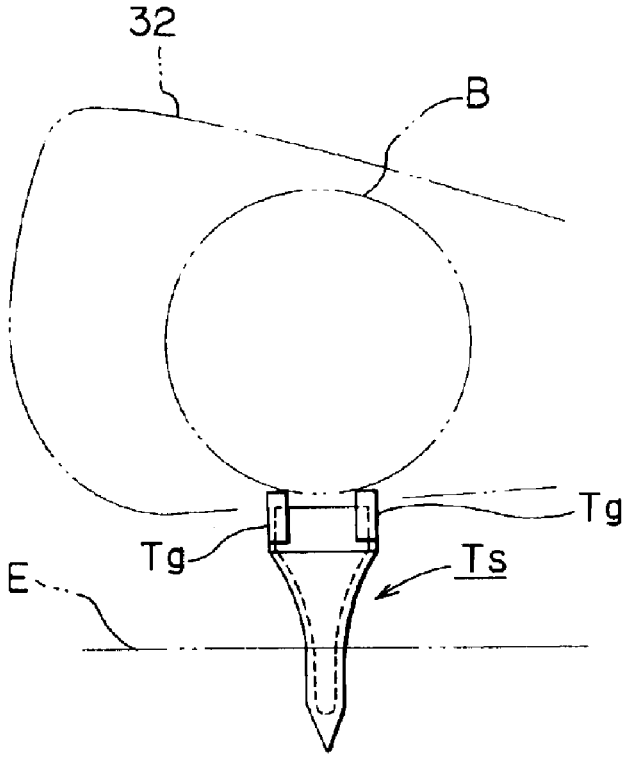
FIG. 7 is a diagram illustrating use (action) of the golf tee shown in FIG. 5, including a front view thereof.

As shown in FIG. 7, the golf tee Ts is used while the lower portion thereof is inserted into ground E in a manner similar to that of a regular golf tee. Subsequently, the ball B is placed on the ball placement surfaces Tgr and Tgr which are the upper end Tp of the golf tee Ts, and the ball B is hit with an iron 32 (club). When the golf tee Ts is hit with the iron 32, since the concave hollow portion Tw and the thin wall portion Wt are provided, the golf tee Ts breaks into pieces in a manner similar to that of the golf tee T. In addition, since the guide portions Tg and Tg are provided on the golf tee Ts, the hitting direction Ds is controlled (guided) by the guide portions Tg and Tg when the ball B is hit. That is, the horizontal direction of hitting direction Ds is controlled by the guide portions Tg and Tg arranged in the shape of parallel rails, and in addition, the vertical direction (vertical angle) of the hitting direction Ds is controlled by the curved ball placement surfaces Tgr and Tgr.

The embodiments were described above in detail. However, the present invention is not limited to these embodiments, and regarding the detailed configurations, shapes, materials, numerical values, manufacturing methods, etc., arbitrary changes can be performed within the scope and spirit of the present invention, and furthermore, any addition or deletion can be performed, if necessary.

What is claimed is:

1. A molded golf tee prepared by molding a molding material comprising sand and at least a predetermined quantity of binder in a mold, the molded golf tee comprising:

an upper half portion and a lower half portion;

a cylindrical-shaped upper portion surrounded by a cylindrical-shaped wall portion at an upper most end of the upper half portion; the cylindrical-shaped upper portion extending a predetermined depth from an upper end of the tee;

a concave hollow portion formed beneath the cylindrical-shaped upper portion, wherein the concave hollow portion has an inner surface flaring outwardly in a single continuous curve, extending from a hemispherical-shaped bottom to the cylindrical-shaped upper portion, and joining the cylindrical-shaped upper portion at an obtuse angle, wherein the hemispherical-shaped bottom is located at a bottom of the upper half-portion.

2. The golf tee according to claim 1, wherein a phenolic resin or other thermosetting curing agent is used for the binder.

3. The golf tee according to claim 1, wherein a biodegradable plastic is used for the binder.

4. The golf tee according to claim 1, wherein the depth of the concave hollow portion is specified to be one third or more of the total longitudinal length.

5. The golf tee according to claim 1, wherein guide portions for supporting a ball and guiding the ball in a hitting direction are provided integrally at the upper end.

6. The golf tee according to claim 5, wherein the guide portions are arranged in the shape of parallel rails for supporting the ball.

7. The golf tee according to claim 6, wherein top surfaces of the guide portions constitute ball placement surfaces which are formed into curved surfaces having intermediate portions dented downwards.

8. The golf tee according to claim 7, wherein front ends of the guide portions in the hitting direction are positioned higher than rear ends of the guide portions.

9. The golf tee according to claim 1, wherein the golf tee comprises a lower-half portion having a cylindrical shape, and an upper-half portion which gradually increases upwards in diameter from un upper end of the lower-half portion.

10. The golf tee according to claim 9, wherein the upper-half portion of the golf tee includes a wall portion having a thickness of about 1 mm.

11. A molded golf tee prepared by molding a molding material, comprising:

sand and at least a predetermined quantity of binder in a mold;

a concave hollow portion with a predetermined depth from an upper end of the tee and having a cylindrical-shaped wall portion at an upper end thereof; and guide portions in the shape of parallel rails provided at upper end of the tee and extending outwardly from opposite sides edges of the wall portion, top surfaces of the parallel rails being concave-shaped and constituting ball placement surfaces for supporting a ball and guiding the ball in a hitting direction, wherein low points of the concave-shaped parallel rails are disposed over the concave hollow portion.

12. The molded golf tee prepared by molding a molding material according to claim 11, wherein the low points of the parallel rails are disposed inwardly of a perimeter of the wall portion and off set from a central axis of the tee in a direction away from the hitting direction.

13. The molded golf tee prepared by molding a molding material according to claim 11, wherein front ends of the parallel rails in the hitting direction are positioned higher than rear ends of the parallel rails.

* * * * *